United States Patent [19]

Minker

[11] Patent Number: 4,803,907

[45] Date of Patent: Feb. 14, 1989

[54] DRUM BEATER BALL

[76] Inventor: Gary Minker, 4271 122nd Dr. N., Royal Palm Beach, Fla. 33411

[21] Appl. No.: 120,099

[22] Filed: Nov. 13, 1987

[51] Int. Cl.[4] ..... G10D 13/02

[52] U.S. Cl. ..... 84/422 R; 84/422 S

[58] Field of Search ..... 84/104, 170, 254, 402, 84/404, 422, 477 B

[56] References Cited

U.S. PATENT DOCUMENTS

| | | | |
|---|---|---|---|
| 1,343,164 | 6/1920 | Smith | 84/422 R |
| 1,598,203 | 8/1926 | Laukandt | 84/254 X |
| 3,422,719 | 1/1969 | Payson | 84/422 S |
| 4,644,842 | 2/1987 | Aluisi | 84/422 R |

*Primary Examiner*—Lawrence R. Franklin

*Attorney, Agent, or Firm*—Eugene F. Malin

[57] ABSTRACT

A drum engaging device having a hollow interior and a freely movable body enclosed therein for imparting resonant frequency high sound pressure level with longer (extended) compression domain of member first engagement to the membrane of a drum by varying the weight of the body and varying the time of engagement of the body after the device has engaged the membrane.

7 Claims, 1 Drawing Sheet

DRUM BEATER BALL

BACKGROUND OF THE INVENTION

This invention relates to an adjustable impact device in direct control by the user in the form of an improved beater ball for a percussion device.

The prior art discloses non-adjustable impact devices and beater balls with foot operated pedal mechanism for moving the beater ball into contact with the percussion object and away from the percussion object. Beater balls are constructed of wood and many other types of materials. These devices are characterized by structure having an integral arm and solid beater mechanism of little complexity. One activation of these assemblies would produce one impact upon the drum resulting in the transmission of one series of pressure waves. A human ear would then detect one corresponding sound.

SUMMARY OF THE INVENTION

This invention relates to a new and improved kick drum, i.e. beater ball, which is so constructed to contact the membrane of the drum to produce more contact time with the membrane in a continuously depressed condition from a single beat of the beater ball on the drum. This provides a very dynamic rhythmic feel and sound without requiring continuously depressing the beater ball foot operated mechanism. .

The beater ball of the invention is adjustable allowing, through a single activation of the mechanism, for the intensification of sound or the creation of two discrete sounds closely related in time.

The beater ball of the invention results in greater resonance and the beater ball of the invention results in greater perceived resonance and dynamic range than achieved heretofore.

An object of the invention is to provide a unique construction of a kick drum beater ball permitting the intensification and prolongation of the sound, especially of the musical tone.

Another object of the invention is to provide a beater ball that will remain in contact with the drum membrane at a greater depth for a longer period of time.

Another object of the invention is to provide construction of a beater ball having a hollow chamber containing one movable body for imparting a second engaging mass for striking the drum membrane quickly after the first engagement by the beater ball face.

A still further object of the invention is to provide a beater ball having a hollow chamber having therein a movable body and means for adjusting the length of the chamber for achieving different degrees of movement of the movable body before impact of the second engaging mass.

A yet further object of the invention is to provide a novel kick drum beater ball so constructed that in the drum engaging motion of the beater ball the exterior face initially imparts a first contact of the drum while the movable body continues to move within the beater ball causing a resultant second contact of the beater ball with the membrane of the kick drum.

Finally, the object of the invention is to provide a beater ball having all of the above mentioned features.

Still other objects of the invention will be readily apparent to those skilled in the art in light of the following detailed description of the invention.

DETAILED DESCRIPTION OF THE INVENTION

Figure 1:
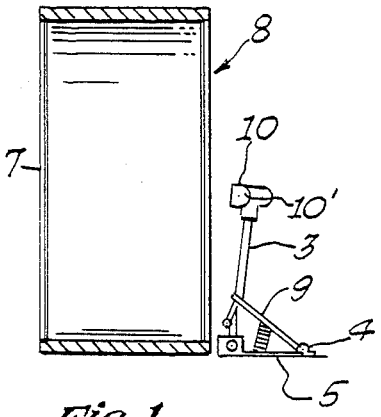
FIG. 1 is a perspective view of the beater ball and drum.
Figure 2:
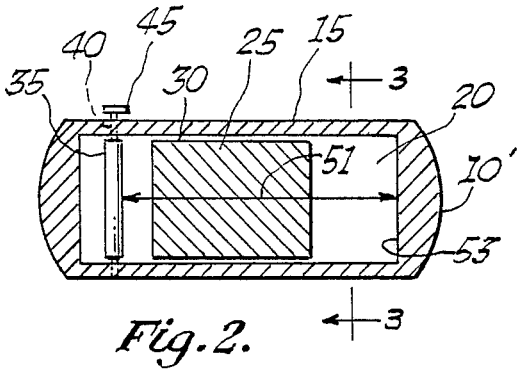
FIG. 2 is a sectional view of the novel beater ball of the invention.
Figure 3:
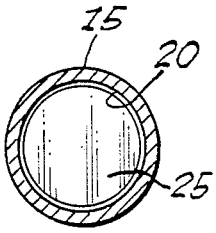
FIG. 3 is a sectional view taken along line 3—3 of FIG. 2.

Referring generally to FIGS. 1, 2 and 3 of the drawings, the drum 7 is shown with a membrane 8. A foot pedal 9 is connected to base 5 by hinge 4. Arm 3 is connected to base 5 by hinge 2 to move a beater ball 10 against kick drum 7 including the usual drummer pot or treadle means for actuation means which effects movement of the beater ball against the membrane of a kick drum. A spring normally holds the beater ball off the membrane 8.

The beater ball 10 includes a hollow casing 15 having a chamber 20 therein. The chamber 20 contains a movable body or element 25 having substantially the same cross-sectional shape as the interior cross-sectional shape of casing 15. The outer periphery of body 25 is contiguous to the inner periphery and is sufficiently spaced at 30 therefrom to permit body 25 to freely move back and forth within chamber 20 from the front at 10' to the rear of the beater ball.

Figure 6:
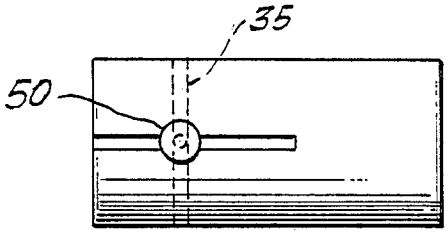
FIG. 6 is a sectional view taken.

The effective length of chamber 20 may be varied by means generally indicated by numeral 26. This means 26 may include a plate 35 contiguous to the interior surface of casing 15 defining a space 40 therebetween and a threaded stem or rod 45 extending through a slot 50 as shown in FIG. 6 of casing 15. Rod 45 includes means 55 so shaped to permit a drummer to manually move rod 45 in slot 50 along the length thereof for moving plate 30 in chamber 20. Means 55 is a wing nut or similar device for frictionally engaging the casing for maintaining plate 30 in a preselected position. The user may adjust the length 51 of the chamber to vary timing of the second impact when the weight 25 engages the wall 53 and the membrane 8.

The casing chamber and body 25 may be of various shapes and constructed of various materials without adversely affecting the ultimate function of the beater ball as stated aforesaid.

Figure 5:
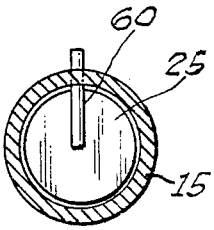
FIG. 5 is a sectional view of a modification of the beater ball of FIG. 1.

Means other than shown on FIG. 2 for varying the effective length of chamber 20 is shown in FIG. 5. Casing 15 includes a plurality of spaced threaded passages 60 along the length thereof for threadedly selectively receiving a rod 65 projecting within the interior of chamber 20 for selectively varying the effective distance of movement of body 25.

EXAMPLE OF DIMENSIONS OF BEATER BALL

Two and one-half inches horizontal orientation, perpendicular to one and one-half inches vertical orientation.

INSIDE DIAMETER OF CASING 15

Three tenths of one inch.

OUTSIDE DIAMETER OF BODY 25 . . .

One and one-half inches.

OUTSIDE DIMETER OF PLATE 35 . . .

Two inches.

Figure 4:
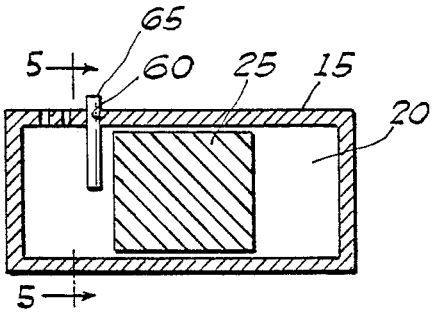
FIG. 4 is a sectional view taken along line 5—5 of FIG. 5.

FIG. 3 represents a cross-section of FIG. 2 illustrating body 25 within casing 15. FIG. 4 is a similar cross-section of FIG. 5.

The end of the beater ball may be removable to replace weight 25 with heavier or lighter weights. The selection of the changeable weight mass serves to select the variable time delay of secondary impact and to also select the mass force of the impact, both first and secondary.

FIG. 7 illustrates the combined non-time-related accumulation of the sound pressure level wave patterns and the said wave pattern of a conventional beater ball impacting a drum. The graph illustrates the relative decible magnitude in relation to particular frequencies.

In alternative embodiments, wherein the beater ball is adjusted to allow maximum movement of body 25, it is possible to create a second set of sound wave patterns which are off-set in frequency from the first set. This further creates unique and pleasing musical sounds, in succession, however a much closer interval than merely hitting a drum twice.

While there have been described above the principals of this invention in connection with specific apparatus, it is to be clearly understood that this description is made only by way of example and not as a limitation to the scope of the invention.

What is claimed is:

1. A drum engaging-impact system for providing a first drum membrane engagement and impact followed by an automatic second impact comprising:

a drum engaging device including;

a casing surrounding a relatively long chamber therein having an inner surface and a drum engaging surface at one end of said chamber;

a freely movable weighted body within said chamber, freely movable therein, said body having an exterior surface in contact with said inner surface;

said exterior surface of said body being generally contiguously spaced from said inner surface of said casing; and said chamber having a rear surface and a forward surface positioned behind said drum engaging surface;

said body having a rear body surface engageable with said chamber rear surface when said device is initially accelerated and a front body surface engageable with said chamber forward surface after a relatively short time of said device engaging a drum surface, thereby providing second impact.

2. A drum engaging-impact system as set forth in claim 1, wherein:

said casing including means for varying the length of movement of s id body within said chamber thereby varying the timing of the engagement of said body and said forward surface after said device engages a drum surface to provide second impact.

3. A drum engaging-impact system as set forth in claim 2, wherein:

a means to replace said interior body with a body of a different weight.

4. In combination with a drum having a membrane and including said drum engaging device and means structually connected to said drum engaging device for moving said drum engaging device into contact with said membrane, the improvement wherein said device comprises:

a drum engaging device including a casing surrounding a relatively long chamber therein having an inner surface and a drum engaging surface at one end of said chamber;

a freely movable weighed body within said chamber, freely movable therein, said body having an exterior surface in contact with said inner surface;

said exterior surface of said body being generally contiguously spaced from said inner surface of said casing; and said chamber having a rear surface and a forward surface positioned behind said drum engaging surface;

said body having a rear body surface engageable with said chamber rear surface when said device is initially accelerated and a front body surface engageable when said chamber forward surface after relatively short time of said device engaging a drum surface;

said casing including means for varying the length of movement of said body within said chamber thereby varying the time of the engagement of said body and set forward surface after said device engages the drum; and a means to replace an interior body with the body of a different weight, whereby said weighed body of said drum engaging device provide initial and secondary impact upon said drum.

5. A method of increasing the decible intensity of musical sound, increasing the frequency duration of musical sound waves by impact of a drum engaging device, comprising:

initially striking said drum with said drum engaging device;

said drum engaging device having an interior chamber, said chamber housing a movable interior body, said body moving longitudinally within said chamber;

said body causing second impact of said drum engaging device upon said drum subsequent to said initial contact;

whereupon said initial and subsequent contact create musical sounds of greater decible intensity and frequency prolongation.

6. The method of claim 5 wherein said movable body is interchangeable with movable bodies of a different weight.

7. The method of claim 5 wherein said chamber includes adjusting means for adjusting the length of travel of said movable body within said drum engaging device, whereby the time delay between said initial and subsequent impact is adjustable.

* * * * *